United States Patent [19]

Uetrecht

[11] 4,388,850

[45] Jun. 21, 1983

[54] MULTIPLE OCTAVE GENERATOR TUNING SYSTEM

[75] Inventor: Dale M. Uetrecht, Colerain Township, Hamilton County, Ohio

[73] Assignee: Baldwin Piano & Organ Company, Cincinnati, Ohio

[21] Appl. No.: 139,643

[22] Filed: Apr. 14, 1980

Related U.S. Application Data

[63] Continuation of Ser. No. 832,353, Sep. 12, 1977.

[51] Int. Cl.[3] ..... G10H 1/02

[52] U.S. Cl. ..... 84/1.24; 84/DIG. 4; 84/1.01

[58] Field of Search ..... 84/1.01, 1.24, DIG. 4, 84/454, DIG. 18

[56] References Cited

U.S. PATENT DOCUMENTS

| | | | |
|---|---|---|---|
| 3,450,825 | 6/1969 | Cunningham | 84/1.01 |
| 3,647,928 | 3/1972 | Turner | 84/DIG. 4 |
| 3,816,635 | 6/1974 | Vetrecht | 84/1.01 |
| 3,828,109 | 8/1974 | Morez | 84/DIG. 4 |
| 3,956,961 | 5/1976 | Peterson | 84/DIG. 4 |
| 3,968,719 | 7/1976 | Sanderson | 84/454 |

*Primary Examiner*—David Smith, Jr.
*Assistant Examiner*—Forester W. Isen
*Attorney, Agent, or Firm*—Kirkland & Ellis

[57] ABSTRACT

A multiple octave generator system for providing tones in an electronic organ permits the production of both ensemble and celeste effects by providing the appropriate amounts of detuning among cascaded ranks of divide-by-two locked octave type tone generators. The generator system programs from the ranks adjacent octaves of generator into groups having slightly overall stretched tuning which, when combined with an unstretched rank, closely resemble pipe organ celeste tuning. This permits the celeste beat rate of the lower octaves to be increased to a more desirable rate without causing the beat rate of the upper octaves to become too fast.

4 Claims, 6 Drawing Figures

F
E
D
C
B
A
OCTAVE 1
OCTAVE 2
OCTAVE 3
OCTAVE 4
OCTAVE 5
OCTAVE 6
OCTAVE 7
OCTAVE 8
+5¢
+1.5¢
+2¢
-2.5¢
-3¢
+3.5¢
-5.5¢
+8.5¢

MULTIPLE OCTAVE GENERATOR TUNING SYSTEM

This is a continuation of application Ser. No. 832,353, filed Sept. 12, 1977.

BACKGROUND OF THE INVENTION

1. Field of the Invention

The present invention relates to generator tuning systems for electronic organs, and more particularly, a multiple octave generator tuning system that provides detuning between octaves and thereby results in enhanced musical effects.

2. Description of the Prior Art

Multiple octave tuning systems for electronic organs are known in the art. For example, U.S. Pat. No. 3,450,825—Cunningham, discloses a system of locked-octave generator ranks that provides a celeste effect in an electronic organ. U.S. Pat. No. 3,004,460—Wayne, discloses an audio modulation system using continuous phase changers for achieving an ensemble effect in electronic organs using a locked octave generator rank. In addition, U.S. Pat. No. 3,049,959—Meyer, discloses a method of obtaining ensemble and celeste effects in electronic organs which use locked octave generator ranks. U.S. Pat. No. 3,816,635—Uetrecht, also discloses tone generator systems for electronic organs that allow production of the notes of the musical scale from a single oscillator. Some of the prior art systems (Meyer, Cunningham) programmed the outputs of differently tuned divide-by-two locked octave generator ranks alternately to overcome to some extent the ensemble disadvantages of "locked" generators. However, the presently disclosed system has an improved stretched programming scheme which provides unlocked scales for individual stop groups and provides parallel stretched scales for better celeste effects. The prior art (Wayne) discloses that an optimum celeste tuning requires less percentage detuning for the high notes than for the low notes. However, Wayne's method did not use multiple generator ranks but instead modulated tonal outputs from a single rank. Meyer's multiple generator ranks did not provide the desired taper to the detuning. Cunningham used two non-overlapping locked octave generator ranks to obtain a celeste and tuned the higher pitched rank flat (compressing the celeste pitch scale) in an attempt to achieve the desired taper. Because the presently disclosed system uses parallel stretched generator groups it makes it possible to have several degrees of optimally tapered celeste detuning with only a single locked octave celeste generator rank. This is advantageous both musically and economically.

BRIEF DESCRIPTION OF THE INVENTION

The present invention comprises an improved tone generator system for electronic organs. The generator system includes a clock oscillator for producing the clock signals for a rate scaler frequency shifter and for driving one generator rank directly. The rate scaler frequency shifter produces clock signals for driving the other generator ranks. The improved system in accordance with the present invention comprises a plurality of ranks of divide-by-two locked octave type generator means, each generator rank extending over four octaves, for producing the organ tones. The present invention also comprises a system of programs for grouping the octave sections of each generator rank so as to provide a minimum number of adjacent octaves that are locked within each program as notes are played up and down the musical scale. In addition, the present invention also comprises means for achieving ensemble and celeste effects by the generator ranks being detuned with respect to each other by a predetermined amount. The present invention also comprises means for achieving scales of stretched tuning, the lower octaves being tuned slightly below the nominal frequency and the higher octaves being tuned slightly above the nominal frequency. The present invention may also comprise means for increasing the beat rate of the lower octaves without causing the beat rate of the higher octaves to become undesirably fast.

Thus, it is a principal object of the present invention to provide an improved generator tuning system for an electronic organ that permits enhanced musical effects to be achieved, including detuning between adjacent octaves, stretched tuning, celeste and ensemble effects, and an increased beat rate in the lower octaves without causing a corresponding increase in the beat rate in the higher octaves.

These and other objects, advantages, and features, shall hereinafter appear, and for the purposes of illustration, but not for limitation, exemplary embodiments of the present invention are illustrated in the accompanying drawings.

DETAILED DESCRIPTION OF THE PREFERRED EMBODIMENTS

Figure 1:
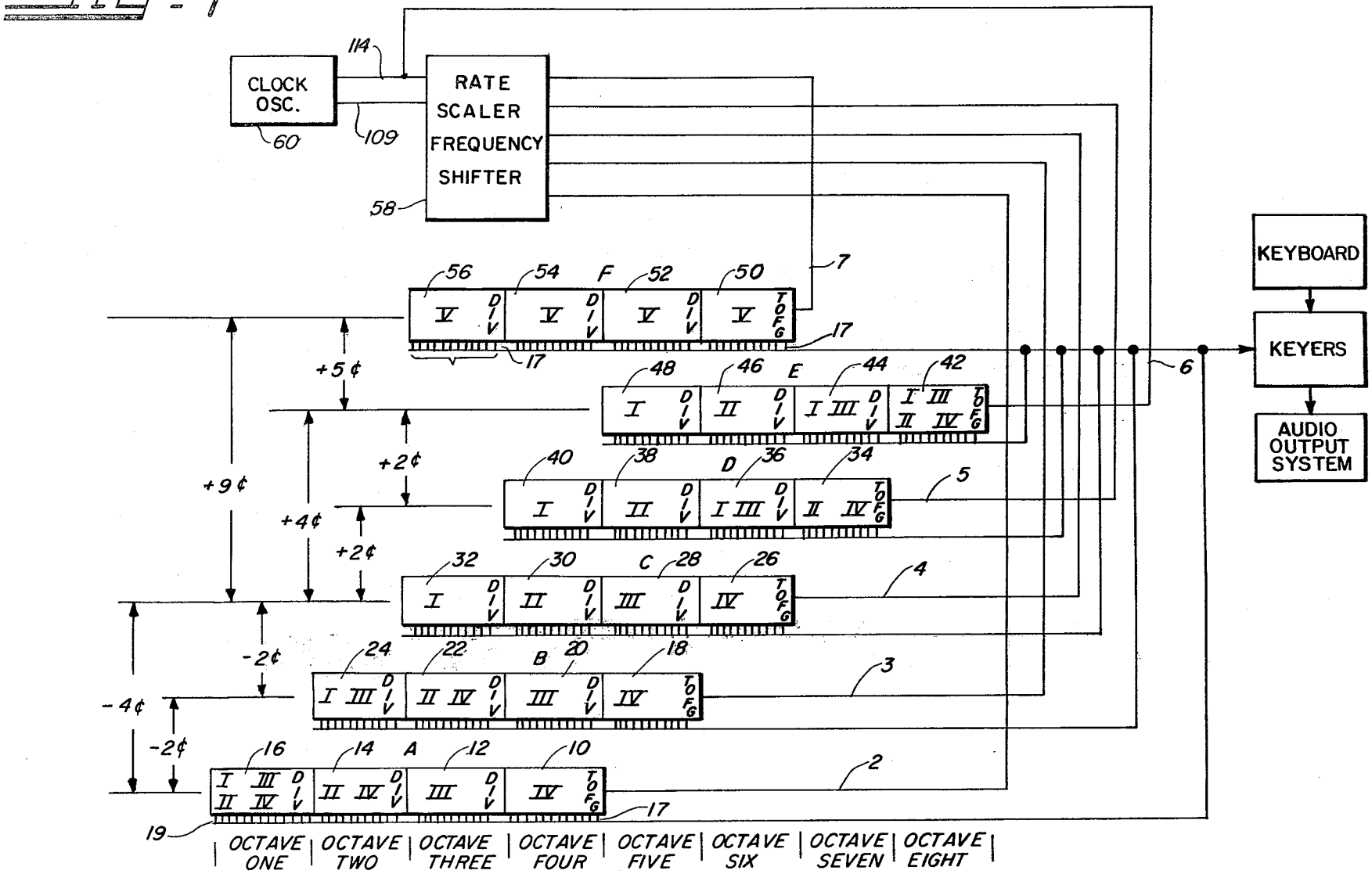
FIG. 1 is a block diagram of a preferred embodiment of the present invention.

Referring to the embodiment illustrated in FIG. 1, the improved tone generator system 1 comprises six groups of blocks labeled A, B, C, D, E and F, representing six locked octave type generator assemblies or ranks. Each of these six generator assemblies or ranks represents three octaves of divide-by-two-type locked-octave tone signal generators (DIV) each of which may be driven by an individual top octave frequency generator (TOFG) which provides tone signals for the fourth (top or highest) octave. The individual octave of dividers comprises conventional transistorized flip-flops, such as are common in the art. The top octave frequency generator is of an appropriate conventional type, and may comprise any of the systems disclosed in U.S. Pat. No. 3,816,635—Uetrecht. Alternatively, the top octave could be comprised of twelve master oscillators, one for each note of the scale for each generator rank. In FIG. 1, the top octave frequency generators for generator ranks A, B, C, D and F are clocked from a rate scaler frequency shifter 58 on leads 2, 3, 4, 5 and 7, and the top octave frequency generator of rank E is clocked by clock oscillator 60 on lead 6.

Specifically, generator rank A comprises a top octave frequency generator (TOFG) section 10 and three slave divide-by-two divider sections (DIV) 12, 14 and 16, each section having twelve outputs 17 for each of the twelve semitones of the musical scale, except that in octave one there are thirteen tone signal outputs 19 from section 16 for purposes which will be more fully explained below. Similarly rank B comprises a top octave frequency generator section 18 and three divider sections 20, 22 and 24; rank C comprises a top octave frequency generator section 26 and three divider sections 28, 30 and 32; rank D comprises a top octave frequency generator 34 and three divider sections 36, 38 and 40; and rank E comprises a top octave frequency generator 42 and three divider sections 44, 46 and 48. Generator rank A is detuned at minus 4 cents and generator rank B is detuned at minus 2 cents from generator rank C, which is tuned as closely as possible to standard pitch, by the inputs on leads 2, 3 and 4 respectively from frequency shifter 58. Generator rank D is detuned at plus 2 cents and generator rank E is detuned at plus 4 cents from standard pitch by the input on leads 5 and 6 respectively. Generator rank F is the celeste generator and comprises top octave frequency generator 50 and three divider sections 52, 54 and 56. The celeste generator rank is detuned at plus 9 cents from standard pitch by the input on lead 7.

All generator sections of the system shown in FIG. 1 have twelve tone signal outputs each, except for the lowest octave of generator rank A which has one additional output, as indicated by multiple leads 19 at the section 16 so that ninety seven total notes may be played across the eight octaves. For simplicity throughout the diagram, the outputs 17 are not shown for all of the generator sections but it should be recognized that each section has the appropriate outputs which are connected to appropriate keying or switching circuits appropriately controlled by the keyswitches of the keyboard that allow transmission of the tone signal to an appropriate audio output system.

Figure 3:
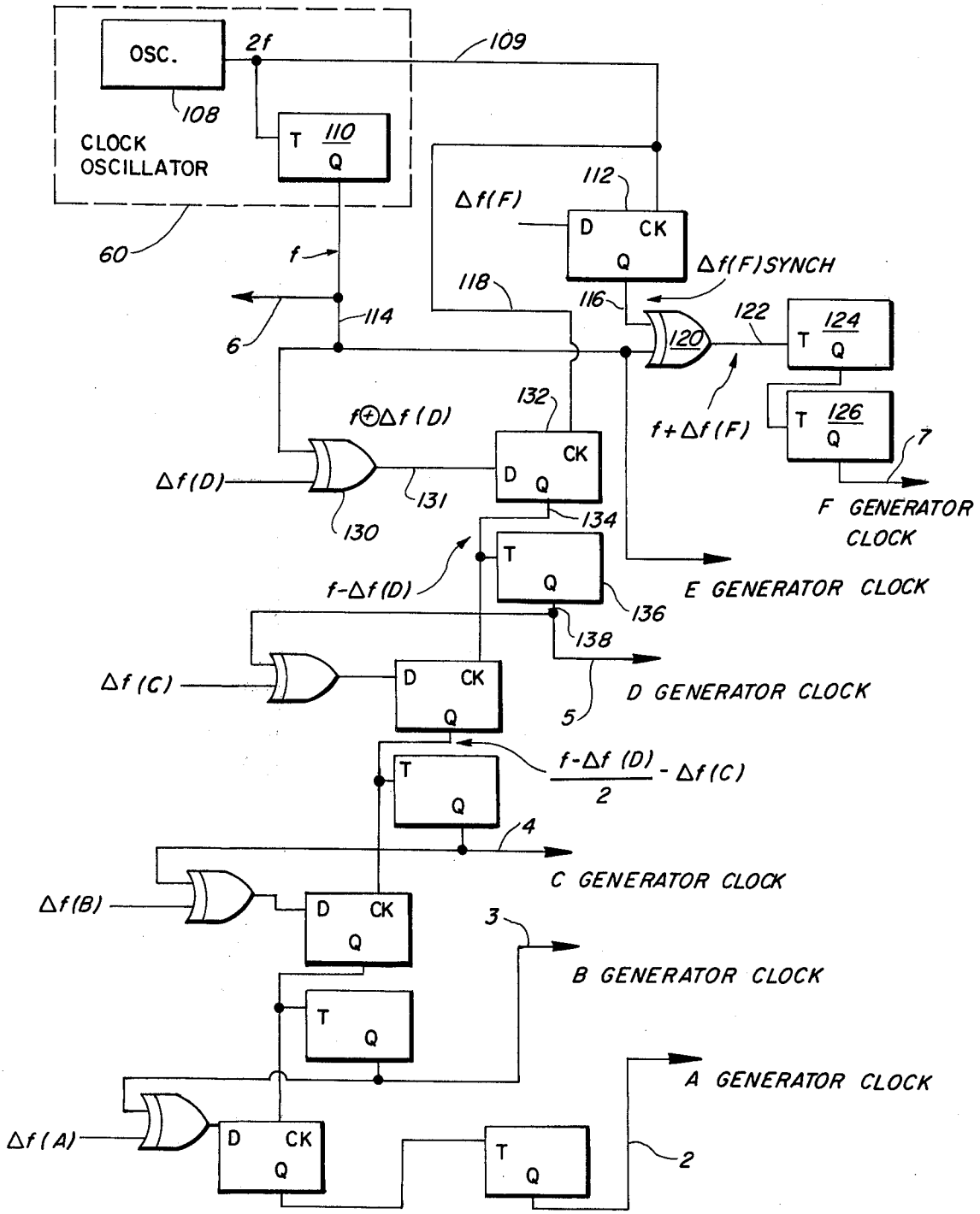
FIG. 3 is a schematic diagram of the clock oscillator and rate scaler frequency shifter of the preferred embodiment of the present invention illustrated in FIG. 1.

FIG. 3 shows a detailed circuit diagram of the clock oscillator 60 and rate scaler frequency shifter 58 appropriate for the multiple octave generator tuning system illustrated in FIG. 1. A conventional oscillator 108 generates a master clock output signal at frequency *2f* on lead 109. The *2f* signal is divided by two by toggle flip-flop 110 to provide the other clock oscillator output at frequency f on lead 114. The f signal output of the clock oscillator directly clocks the E generator rank on lead 6; therefore, normally the clock oscillator is tuned plus 4 cents sharp so that generator rank C produces tone signals at the standard pitch frequency (such as defined in Table 13.2 of American National Standards Institute standard S1.1-1060 (R1976)), available from the American National Standards Institute, 1430 Broadway, New York, N.Y. 10018, or many research libraries.

Figure 4:
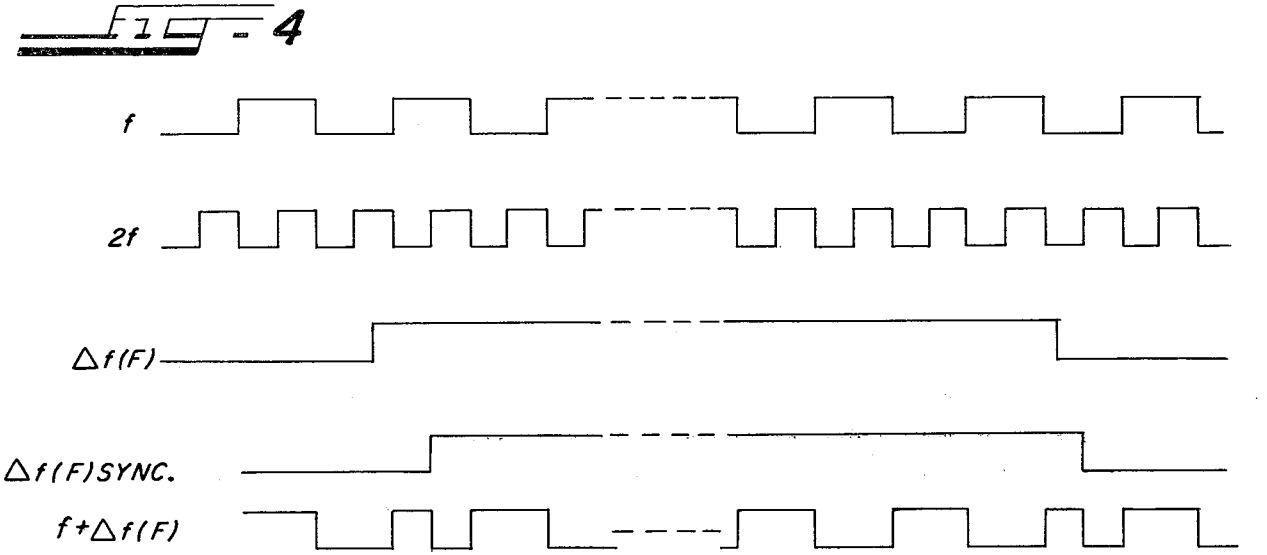
FIG. 4 is a timing diagram showing the timing relationship of the clock signals and the signals of the rate scaler frequency shifter of the preferred embodiment of the present invention.

The rate scaler provides five detuned clock signals on leads 2, 3, 4, 5 and 7 at preselected frequencies to drive generator ranks A, B, C, D and F respectively. The *2f* output from clock oscillator 60 is applied to the clock (ck) input of delay flip-flop 112, which causes flip-flop 112 to sample the frequency Δf(F) applied on the D input to flip-flop 112 so that the output on lead 116 is synchronized with the positive transitions of the *2f* signal. The difference frequency Δf(F) as well as the difference frequency Δf(A) through Δf(D) for the A, B, C, D and F generator ranks are predetermined frequencies that result in the proper detuning among the generator ranks. The Δf(A) through Δf(F) signals at the respective difference frequencies are obtained either from conventional oscillators or from one of the available outputs of each respective generator rank which produces the desired difference frequencies. Flip-flop 112 clocks on a positive transition yielding an output signal Δf(F) sync on lead 116. The transitions of the Δf(F) sync signal are synchronized with those of the *2f* signal as shown in FIG. 4. Flip-flop 110 toggles on a negative transition of the *2f* signal to produce the f signal. The f signal and the Δf(F) sync signal are then combined by EXCLUSIVE-OR gate 120 yielding f+Δf(F) on lead 122. As the timing diagram in FIG. 4 shows, for each cycle of Δf(F) (one positive and one negative transition) the output of EXCLUSIVE-OR gate 120 has one more cycle than f. The f+Δf(F) output signal from gate 120 is used to toggle flip-flop 124, the Q output of which is used to toggle flip-flop 126, thus dividing the f+Δf(F) signal by four. The output at lead 7 of flip-flop 126 provides the F generator clock signal to the top octave frequency generator 50 of the F generator rank in FIG. 1.

As shown in FIG. 3, the f signal is also combined with Δf(D), the difference frequency signal required for the D generator rank, in EXCLUSIVE-OR gate 130, yielding the output f⊕Δf(D) on lead 131. This f⊕Δf(D) signal is then sampled by delay flip-flop 132 which is clocked by the *2f* signal yielding on output signal on output lead 134 of fΔf(D). The frequency of this signal is then halved by toggle flip-flop 136, the output of which on lead 138 provides the D generator clock signal on lead 5 to top octave frequency generator 34 of the D generator rank in FIG. 1.

Figure 5:
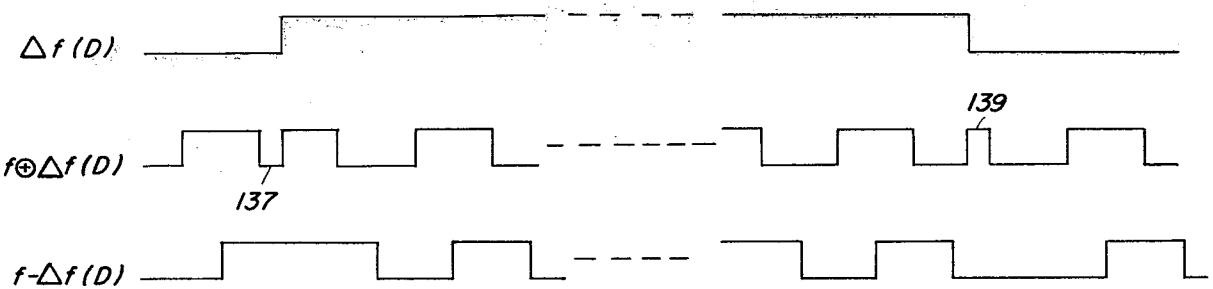
FIG. 5 is a timing diagram showing the timing relationship of other signals of the rate scaler frequency shifter of the preferred embodiment of the present invention.

The timing diagram in FIG. 5 illustrates why the difference frequency Δf is subtracted in the "D" portion of the rate scaler. At each transition of Δf(D), f⊕Δf(D) has a narrow pulse (identified by numerals 137 and 139 in FIG. 5) which is randomly positive or negative and of random width since it need not be synchronized to F. This narrow pulse is always less than one-half the period of *2f* and is therefore ignored by flip-flop 132.

The portion of the rate scaler circuit that produces the C generator clock signal operates identically to that for the D generator clock signal except at approximately one-half the frequency. The output 144 of delay flip-flop 142 is $$\frac{f-\Delta f(D)}{2}-\Delta f(C),$$

where Δf(C) is the appropriate difference frequency for the C generator clock signal and Δf(D) is the appropriate difference frequency for the D generator clock signal. Thus, if f is 2 megahertz and the D generator is to be shifted by 2 cents or 0.12 percent, Δf(D)=2.4 kilohertz. If the C generator clock signal is to be shifted an additional 2 cents or 0.12 percent, Δf(C)=1.2 kilohertz.

From FIG. 3 it should be apparent how the generator clock signals for the B and A generator ranks are each in a similar manner derived from the prior generator rank's clock signal and the appropriate difference frequency.

The generator system of the present invention provides four main stretched generator groups programmed as illustrated in FIG. 1 by the designations I, II, III and IV on the sections of generator ranks A, B, C, D and E. Each group's program represents a preselectable manual (or scale) or voice (or stop) of the organ so that tone signals for keys played in the selected program are produced by the tone generator sections for different octaves as indicated by the program numbers in FIG. 1. This produces desirable ensemble and celeste effects since each octave is unlocked and a stretched inter-octave tuning effect is achieved. For example, as shown in FIG. 1, program I uses section 16 of generator rank A in octave one and is thus 4 cents flat in that octave. Program I uses section 24 of generator rank B in octave two where it is 2 cents flat, and section 32 of generator rank C in octave three where it is 0 cents flat. Program I uses section 40 of generator rank D in octave four where it is 2 cents sharp, section 48 of generator E in octave five where it is 4 cents sharp, section 36 of generator rank D again in octave six, and sections 44 and 42 of generator rank E for octaves seven and eight. The result of this assignment of sections of generator ranks in program I is that adjacent octaves of program I are unlocked except in octaves seven and eight and a stretched inter-octave tuning effect is achieved, that is, the lower octaves are tuned progressively flat and the higher octaves are tuned progressively sharp. Program II uses sections 16 and 14 of generator rank A for octaves one and two and is thus locked in those two octaves. Program II then increases 2 cents per octave, using sections 22, 30, 38, 46 of generator ranks B, C, D and E in octaves three through six respectively. For octave seven, section 34 of generator rank D is used to maintain unlocked octaves. Program II uses section 42 of generator rank E again in octave eight. Therefore, as with program I, the overall tuning is stretched and the octaves are for the most part unlocked in program II. Program III uses section 16 of generator rank A in octave one, section 24 of rank B in octave two, section 12 of rank in octave three, sections 20, 28, 36 and 44 of ranks B, C, D and E in octaves four through seven respectively, and section 42 of rank E in octave eight. Program IV uses sections 16, 14 and 10 of generator rank A in octaves one, two and four, sections 22 and 18 of rank B in octaves three and five, and sections 26, 34, and 42 of ranks C, D and E in octaves six through eight respectively.

Combining either programs II or III with program V, which uses only the celeste generator rank F as illustrated in FIG. 1, provides two celeste tuning combinations. The detuning between programs II and V is 11 cents in octave three, 9 cents in octave four, 7 cents in octave five and 5 cents in octave six. The detuning from the celeste generator of program V from program III is 13 cents in octave three, 11 cents in octave four, 9 cents in octave five and 7 cents in octave six as shown in FIG. 1. Changes of this type in a mathematical function or in a particular set of values, where the changes are consistently in one direction (whether increasing or decreasing) without reversal of direction, are known as "monotonic" changes.

Either conventional multiple contact switches or a multiplex keying system similar to the system illustrated in U.S. Pat. No. 3,746,773—Uetrecht, may be used to implement program utilization of the outputs of different sections of the ranks as keys of different octaves are played. The tone signal outputs are then applied to a conventional audio output system (i.e., filters, amplifier and speaker).

Figure 2A:
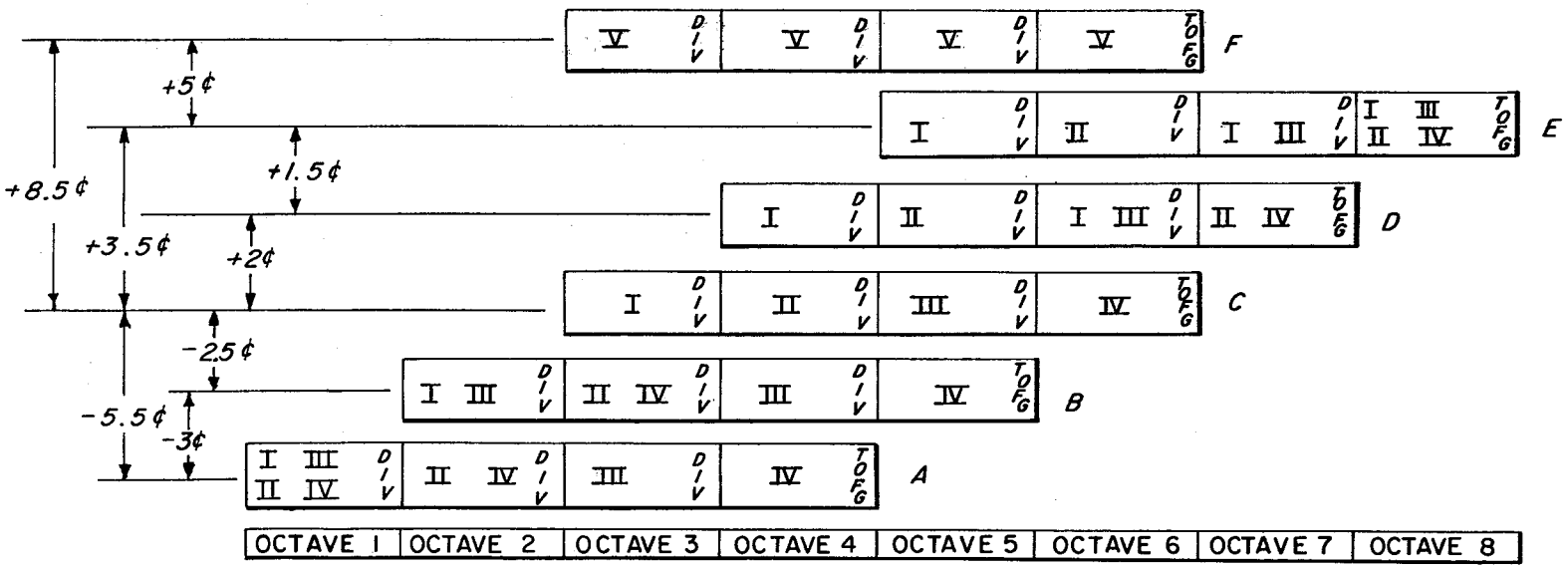
FIGS. 2A and 2B are block diagrams of alternative embodiments of the present invention.

FIG. 2A shows an alternative tuning system where the frequency ratio between generator ranks A and B is 3 cents instead of 2 cents.

Generator ranks B and C are detuned 2.5 cents instead of 2 cents and generator ranks D and E are detuned 1.5 cents instead of 2 cents. The obvious advantage is to obtain an increased beat rate in the lower octaves and a decreased beat rate in the upper octaves. This is not possible where there are only three main generators.

Figure 2B:
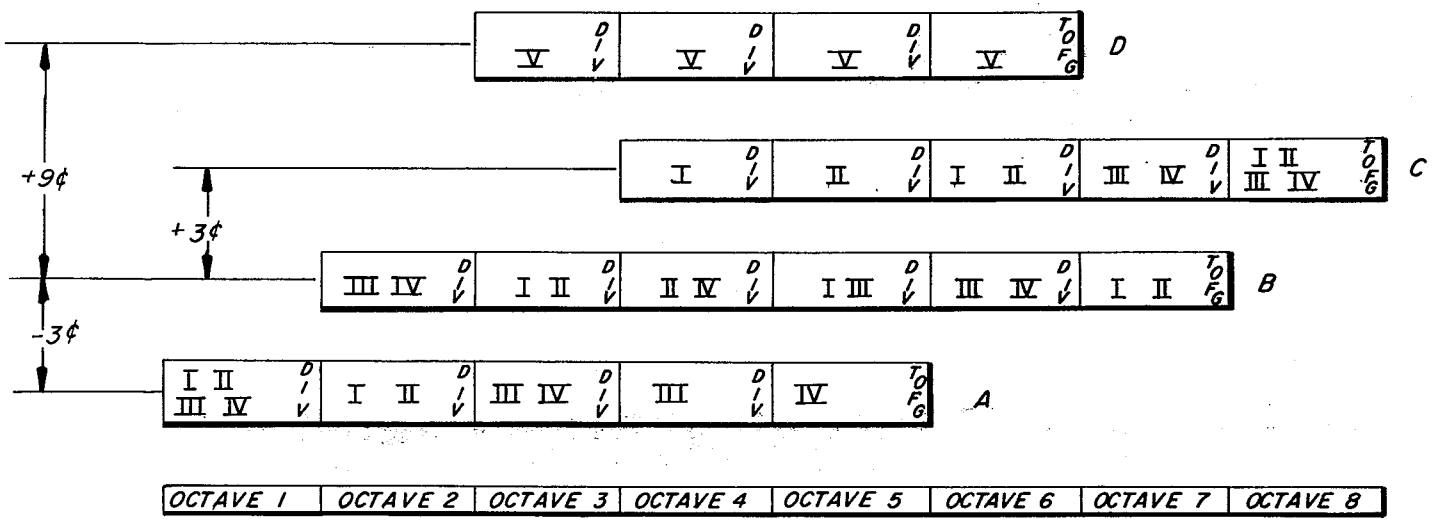

FIG. 2B shows a reduced generator system which retains the basic advantages of FIG. 1, i.e., a single celeste generator, a minimum number of locked octaves, and maximum use of generation in the middle octaves for ensemble effects. Four programs are assigned to the main generators A, B and C. Programs II and III are combined with V (celeste generator) to obtain the two celeste stops. Programs I and II differ from each other only in octaves 4 and 5. Likewise, programs III and IV differ only in octaves 4 and 5.

The depiction of programs I through V in FIGS. 1 through 2B is exemplary only and other variations in the number and make-up of the programs is contemplated. For example, one or more programs could comprise more than one octave or a range, i.e., a portion of an octave from one rank and a portion of an octave from another rank.

It should be apparent that various changes, alterations, and modifications may be made to the present invention without departing from the spirit and scope of the present invention as defined in the appended claims.

I claim:

1. In an electronic organ having at least one keyboard and an audio output system, an improved celeste generator system comprising:

at least two locked multiple octave ensemble generator ranks which produce non-identical ranges of tone signals varying from standard musical frequencies by a substantially constant percentage across each rank;

an additional single locked multiple octave celeste generator rank tuned at least five cents higher in frequency than said ensemble generator ranks and which produces a range of tone signals over more than three octaves which vary from standard musical frequencies by a substantially constant percentage across the entire range;

a first stretched generator group comprising multiple unlocked octaves selected on an octave by octave basis only from more than one of the ensemble generator ranks and which produces tone signals having frequencies which vary from standard musical frequencies in a manner such that an overall stretched inter-octave tuning effect is created within the group;

a second stretched generator group comprising multiple unlocked octaves selected on an octave by octave basis only from more than one of the ensemble generator ranks and which produces tone signals having frequencies which vary from standard musical frequencies in a manner such that an overall stretched inter-octave tuning effect is created within the group;

whereby operation of the keyboard causes selection of corresponding tone signals simultaneously from the celeste generator rank and one or more of the stretched generator groups to produce one or more celeste voices via the audio output system.

2. The improved celeste generator system of claim 1 wherein the top octave of the first stretched generator group is detuned approximately 5 cents and the second stretched generator group is detuned approximately 7 cents flat relative to the first locked multiple octave celeste generator rank, and the detuning of the lower octaves of the first and second stretched generator groups increases monotonically to approximately 11 and 13 cents flat respectively in the lowest octave relative to the first locked multiple octave celeste generator rank.

3. The improved celeste generator system of claim 1 whereien the second stretched generator group is detuned from the first locked multiple octave celeste generator rank by an amount greater than or equal to the amount by which the first stretched generator group is detuned.

4. In an electronic organ having at least one keyboard and an audio output system, an improved celeste generator system comprising:

at least two locked multiple octave ensemble generator ranks which produce non-identical ranges of tone signals varying from standard musical frequencies by a substantially constant percentage across each rank; and an additional single locked multiple octave celeste generator rank tuned at least five cents higher in frequency than said ensemble generator ranks and which produces a range of tone signals over more than three octaves which vary from standard musical frequencies by a substantially constant percentage across the entire range;

a stretched generator group comprising multiple unlocked octaves selected on an octave by octave basis only from more than one of the ensemble generator ranks for producing tone signals having frequencies which vary from standard musical frequencies in a manner such that an overall stretched inter-octave tuning effect is created within the group;

whereby operation of the keyboard causes selection of corresponding tone signals simultaneously from the celeste generator rank and a stretched generator group to produce one or more celeste voices via the audio output system.

* * * * *